United States Patent [19]

Yabu

[11] Patent Number: 4,507,343

[45] Date of Patent: Mar. 26, 1985

[54] NON-SLIP PILE FABRIC AND METHOD OF MANUFACTURING THE SAME

[76] Inventor: Iwao Yabu, 5-21, Tezukayamahigashi 2-chome, Sumiyoshi-ku, Osaka, Japan

[21] Appl. No.: 604,498

[22] Filed: Apr. 27, 1984

[30] Foreign Application Priority Data

Dec. 22, 1983 [JP] Japan ..... 58-243144

[51] Int. Cl.[3] ..... B32B 33/00

[52] U.S. Cl. ..... 428/93; 156/72; 428/95; 428/96

[58] Field of Search ..... 428/93, 95, 96; 156/72

[56] References Cited

U.S. PATENT DOCUMENTS 2,033,881 3/1936 Curtis ..... 428/93

2,400,487 5/1946 Clark ..... 428/93

*Primary Examiner*—Marion E. McCamish

*Attorney, Agent, or Firm*—Wenderoth, Lind & Ponack

[57] ABSTRACT

A non-slip pile fabric is proposed which has a ground fabric formed of warps and wefts, and pile yarns of rigidity wound into the ground fabric so that the pile yarns will raise from one side of the ground fabric substantially in the shape of letter V forming an angle of substantially 45 degrees with respect to the warps and with respect to the surface of the ground fabric, adjacent ones of the pile yarns raising in alternate directions, the piled surface on the one side of the ground fabric being coated with a thermosetting synthetic resin.

2 Claims, 5 Drawing Figures

NON-SLIP PILE FABRIC AND METHOD OF MANUFACTURING THE SAME

BACKGROUND OF THE INVENTION

The present invention relates to a non-slip pile fabric to be secured to the soles of shoes for athletes, the surface of tires, etc. and a method of manufacturing the same.

In order to prevent slipping, it has been a common practice to secure sole members made of rubber, leather or synthetic resin and having undulating surfaces or metal spikes to the soles of shoes for athletes and players.

Apart from the metal spikes, however, the projections on such sole members made of rubber, leather or synthetic resin are worn away in a short time with use. This deteriorates antislipping capacity, thus causing slippage and accident.

SUMMARY OF THE INVENTION

It is an object of the present invention to provide a non-slip pile fabric which eliminates the above-described disadvantage.

In accordance with the present invention there is provided a non-slip pile fabric comprising a ground fabric formed of warps and wefts, and pile yarns of rigidity wound into said ground fabric so that said pile yarns will raise from one side of said ground fabric substantially in the shape of letter V forming an angle of substantially 45 degrees with respect to said warps and with respect to the surface of said ground fabric, adjacent ones of said pile yarns raising in alternate directions, the piled surface on said one side of the ground fabric being coated with a thermosetting synthetic resin.

DETAILED DESCRIPTION OF THE INVENTION

Figure 1:
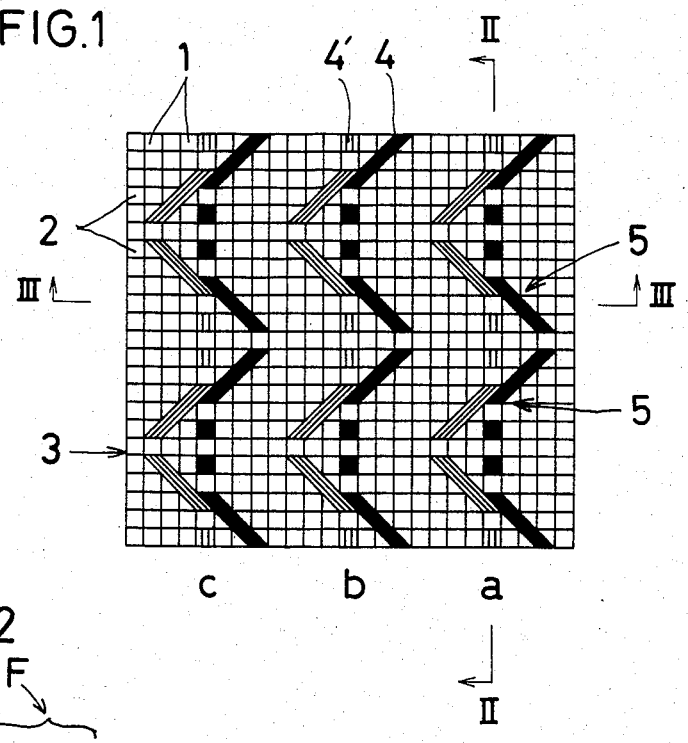
FIG. 1 is a plan view of an embodiment of the present invention.
Figure 2:
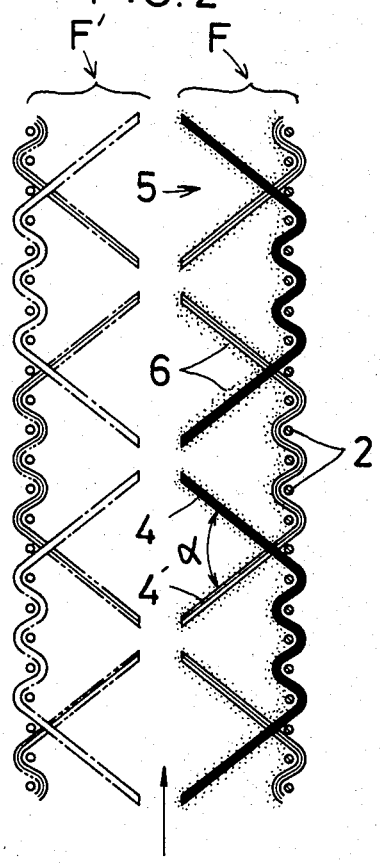
FIG. 2 is a sectional side view taken along line II—II of FIG. 1.
Figure 3:
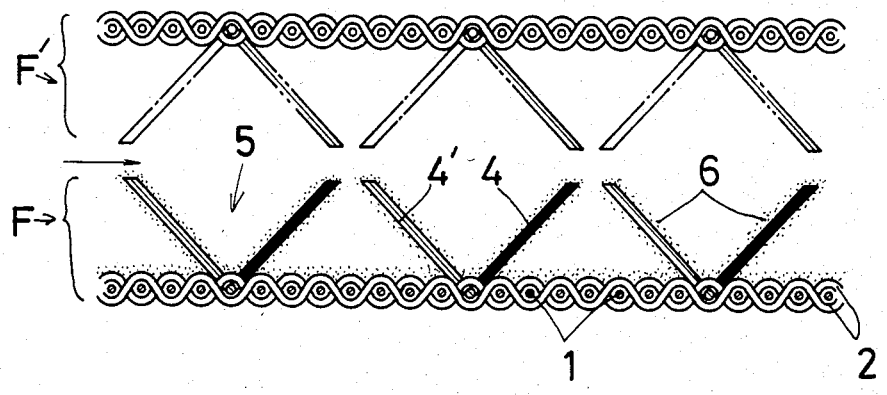
FIG. 3 is a sectional front view taken along line III—III of FIG. 1.

Referring to FIGS. 1–3 illustrating an embodiment, it includes a ground fabric 3 of plain weave formed of ground warps 1 and ground wefts 2. Two pile warps 4, 4' having rigidity are alternately woven into the ground fabric 3 on the same warp line with a density of about eight warps per inch (a, b and c in FIG. 1). The pile warps 4, 4' comprise e,g, a 10-ply twisted yarn having strands each formed of seven 120-denier nylon monofilaments.

Pile warps are raised from one side of the ground fabric 3 so as to form V-shaped piles 5, the ends of which makes an angle of about 45° with respect to the ground fabric 3. The piled surface is relatively thickly coated with a thermosetting synthetic resin such as phenolic resin to form a resin layer 6 to solidify the V-shaped piles 5.

The ground fabric 3 is formed of ground warps 1 (e.g. at a density of 120 warps per inch) and ground wefts 2 (e.g. at a density of 50 wefts per inch). The ground warps 1 comprise e.g. two-folded yarns formed of twenty-four 120-denier nylon filaments. The ground wefts 2 comprise e.g. single yarns formed of twelve 70-denier nylon filaments.

The pile fabric in accordance with the present invention is produced by making a double-pile double-woven fabric of a leno weaving structure with pile yarns 4, 4' woven as doup warps, cutting the pile yarns 4, 4' to form separate pile fabrics F, F', and coating the piled surface of the pile fabric with a thermosetting synthetic resin. The raised ends of pile warps 4, 4' form an angle $\alpha$ of about 70–80 degrees therebetween. The piles raise for a length of about 3 mm from the surface of the ground fabric 3. The slanting pile warps 4, 4', by which the two pile fabrics F, F' are connected, are cut in the middle between these two pile fabrics. (FIGS. 2 and 3) The length of pile, the angle $\alpha$ and the density of piles can be suitably determined according to the application.

Figure 4:
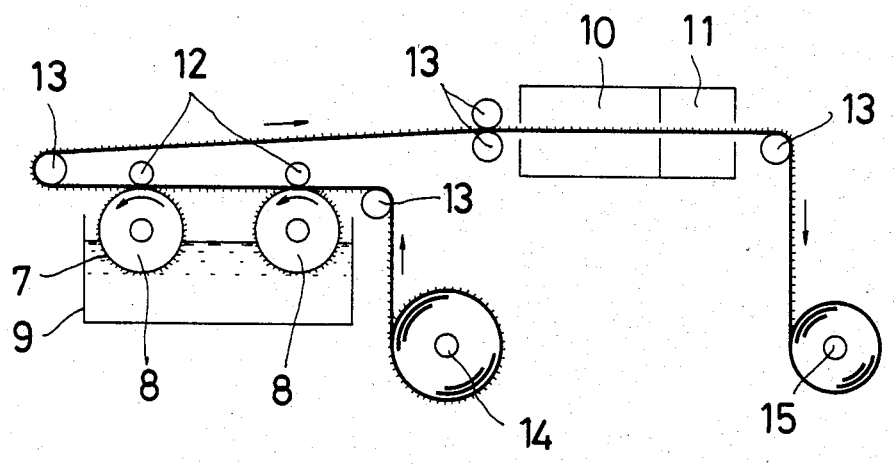
FIG. 4 is a schematic illustration of an apparatus for coating the pile fabric with a thermosetting synthetic resin.

Referring now to FIG. 4, the apparatus for coating the pile fabric with a thermosetting synthetic resin comprises a resin tank 9 in which a plurality of kiss rollers 8 having bristles 7 on their whole cylindrical surfaces are partially dipped in the resin, a hot air drier 10, a heater 11, presser rollers 12 disposed over the kiss roller 8 and adapted to press and hold the moving material thereagainst, guide rollers 13, and a take up beem 15.

In the production, the material for the pile fabric, which has been wound around a material beam 14 with the piled surface turned outwardly, is unwound from the material beam 14. A considerably thick coating of a resin is applied to the piled surface while the material passes between the kiss rollers 8 and the presser rollers 12. In the hot air drier 10 and the heater 11, the V-shaped piles 5 are solidified without getting out of shape. Then the material is wound around a take-up beam 15 so as to be ready for shipment.

During the process of applying the resin to the piled surface, the piled surface is turned downwardly and the kiss rollers 8 are disposed thereunder. Therefore, the reverse surface is entirely kept away from the resin, and the pile fabric in accordance with the present invention can be easily stuck on the soles of canvas shoes or the surface of tires.

The pile warps 4 and 4' may be made of inorganic fibers such as metal fiber, carbon fiber, glass fiber or ceramic fiber. As the thermosetting synthetic resin, epoxy resin, urea or melamine resin may also be used in place of phenolic resin.

Figure 5:
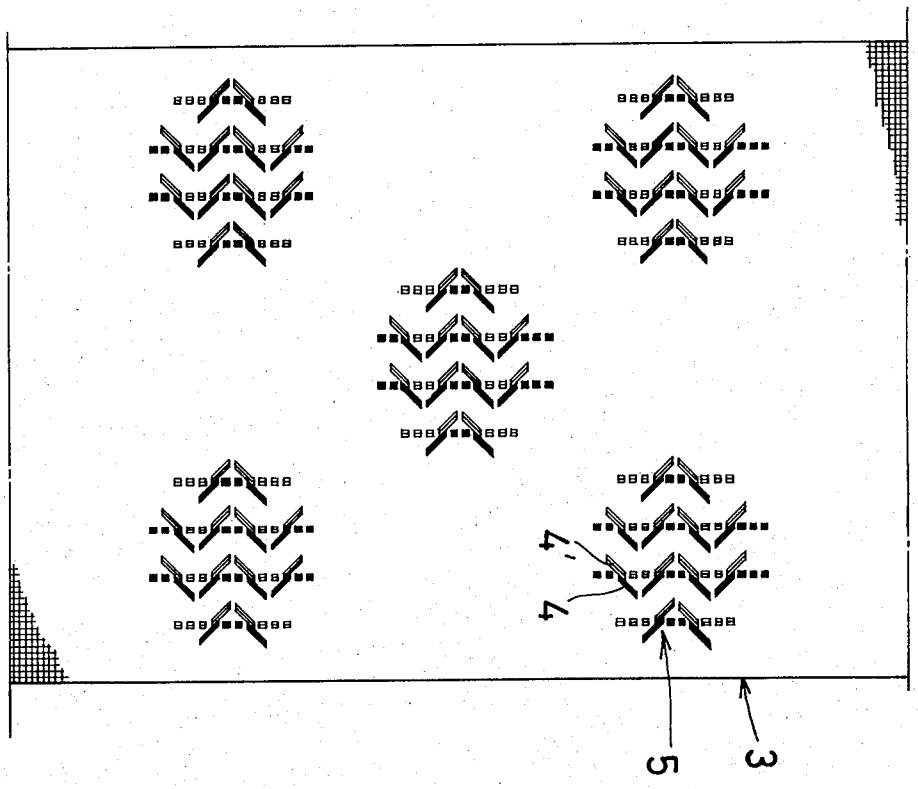
FIG. 5 is a plan view of another embodiment of the present invention.

In another embodiment of the present ivention shown in FIG. 5, the ground fabric 3 is polka-dotted with groups 16 of the V-shaped piles 5. Each group 16 has about ten pairs of V-shaped piles 5 put together in circle and raised from the ground fabric 3 in zigzags. Antislipping capacity is further improved thereby and declines only slightly even when the tips of the piles 5 are worn away to some degree.

Because of the solidified V-shaped piles 5 having sharp-pointed tips and raised in alternately oblique directions, the pile fabric in accordance with the present invention is excellent in antislipping capacity over the conventional antislip members having undulating surfaces and made of rubber or synthetic resin. A laminated coating of a thermosetting synthetic resin solidifies the surfaces of the piles 5 and prevents them from deteriorating and softening by the frictional heat generated during use. This makes the pile fabric of this invention highly durable.

The non-slip fabric in accordance with the present invention have the following advantages:

(1) The finishing of the surface of the pile fabric with resin is suited for a continuous mass production with low cost.

(2) The V-shaped piles 5 are raised alternately at oblique angles with the fabric surface. Such a peculiar way of raising piles cannot be possible with the moldig of rubber or synthetic resin. Solidification of the piles with a coating of a thermosettig synthetic resin gives the fabric excellent antislipping capacity in any directions.

(3) The antislipping capacity only slightly declines even when the tips of the V-shaped piles 5 are worn away to a considerable degree.

(4) During the process of applying the resin, the piled surface is turned downwardly and the brush rollers 8 are disposed thereunder. Therefore, the resin can be uniformly applied not only to the piles 5 but also to the piled surface of the ground fabric 3, while the reverse surface is kept away from the resin. Thus, the pile fabric in accordance with the present invention can be easily stuck on the soles of shoes for athletes or the surface of tires.

(5) Because the pile fabric in accordance with the present invention is comparatively thin and light, shoes for athletes and nonskid tires can be kept light.

(6) Although the spikes of conventional nonskid tires scratch the road surface and generate dust, nonskid tires to which the pile fabric in accordance with the present invention is applied are free from such an adverse effect. When the piles 5 are worn away, the pile fabric can be easily replaced with a new one.

What are claimed are:

1. A non-slip pile fabric comprising a ground fabric formed of warps and wefts, and pile yarns of rigidity wound into said ground fabric so that said pile yarns will raise from one side of said ground fabric substantially in the shape of letter V forming an angle of substantially 45 degrees with respect to said warps and with respect to the surface of said ground fabric, adjacent ones of said pile yarns raising in alternate directions, the piled surface on said one side of the ground fabric being coated with a thermosetting synthetic resin.

2. A process for producing a non-slip pile fabric comprising the steps of making a double-pile double-woven pile fabric of a leno weaving structure with pile yarns woven into a ground fabric serving as doup warps, cutting said pile yarns at the middle between two pile fabrics to separate them from each other, and coating the piled side of said each pile fabric with a thermosetting synthetic resin.

* * * * *